US010961637B2

(12) United States Patent
Freese et al.

(10) Patent No.: US 10,961,637 B2
(45) Date of Patent: Mar. 30, 2021

(54) METHOD FOR ELECTROLYTICALLY DEPOSITING A ZINC NICKEL ALLOY LAYER ON AT LEAST A SUBSTRATE TO BE TREATED

(71) Applicant: Atotech Deutschland GmbH, Berlin (DE)

(72) Inventors: Thomas Freese, Berlin (DE); Ronny Best, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 16/634,974

(22) PCT Filed: Aug. 20, 2018

(86) PCT No.: PCT/EP2018/072425
§ 371 (c)(1),
(2) Date: Jan. 29, 2020

(87) PCT Pub. No.: WO2019/063197
PCT Pub. Date: Apr. 4, 2019

(65) Prior Publication Data

US 2020/0240036 A1 Jul. 30, 2020

(30) Foreign Application Priority Data

Sep. 28, 2017 (EP) ..... 17193725

(51) Int. Cl.
*C25D 3/56* (2006.01)
*C25D 21/12* (2006.01)
*C25D 17/10* (2006.01)

(52) U.S. Cl.
CPC ..... *C25D 21/12* (2013.01); *C25D 3/565* (2013.01); *C25D 17/10* (2013.01)

(58) Field of Classification Search
CPC ..... C25D 3/562; C25D 3/565
USPC ..... 205/246
See application file for complete search history.

(56) References Cited

U.S. PATENT DOCUMENTS

| | | | | |
|---|---|---|---|---|
| 2,419,231 A | | 4/1947 | Schantz | |
| 3,945,388 A | * | 3/1976 | Clark | B08B 3/00 134/57 R |
| 8,293,092 B2 | | 10/2012 | Arzt et al. | |
| 2010/0096274 A1 | | 4/2010 | Rowan et al. | |
| 2010/0116677 A1 | | 5/2010 | Fuhrmann | |
| 2015/0337451 A1 | | 11/2015 | Arvin et al. | |
| 2016/0024683 A1 | * | 1/2016 | Dingwerth | C25D 3/22 205/246 |

FOREIGN PATENT DOCUMENTS

| | | | | | |
|---|---|---|---|---|---|
| CN | 2175238 | | | 8/1994 | |
| CN | 203639589 | | | 6/2014 | |
| CN | 204174295 | | | 2/2015 | |
| CN | 204174298 | | | 2/2015 | |
| DE | 3110176 | A1 | * | 10/1982 | C25D 17/10 |
| DE | 202008014947 | U1 | | 3/2009 | |
| EP | 0100777 | A1 | | 2/1984 | |
| EP | 3461933 | B1 | | 9/2019 | |
| JP | 58500486 | a | | 3/1983 | |
| JP | 62290895 | A | | 12/1987 | |
| JP | 6326396 | | | 2/1988 | |
| JP | 2001026899 | | | 1/2001 | |
| JP | 2006257492 | A | * | 9/2006 | C25D 5/18 |
| KR | 20030054471 | A | | 7/2003 | |
| WO | 2014147180 | A1 | | 9/2014 | |

OTHER PUBLICATIONS

PCT/EP2018/072425; PCT International Search Report and Written Opinion of the International Searching Authority dated Aug. 31, 2018.
Search Report for corresponding Taiwanese Application No. 107131658 dated Nov. 1, 2019.
Office Action for corresponding Indian Application No. 202027004175 dated May 29, 2020.
Office Action for corresponding Chinese Application No. 201880055354.2 dated Jul. 22, 2020.
Office Action for corresponding Japanese Application No. 2020-517823 dated Sep. 28, 2020 and its English translation.

* cited by examiner

*Primary Examiner* — Edna Wong
(74) *Attorney, Agent, or Firm* — Renner, Otto, Boisselle & Sklar, LLP

(57) ABSTRACT

The present invention is related to a method for electrolytically depositing a zinc-nickel alloy layer on a substrate, wherein the method comprises an interrupting of the execution of the electrolytical deposition of a zinc-nickel alloy layer on the surface of a substrate by terminating applying the current from the external current source to each of the soluble zinc anode(s) and to each of the soluble nickel anode(s); and wherein afterwards at least one soluble zinc anode, which is remaining in the electrolysis reaction container, is electrically connected by an electrical connection element to form an electrical connection to at least one soluble nickel anode, which is remaining in the electrolysis reaction container, for at least a part of the defined period of time in which no current from the external current source is applied to each of the soluble zinc anode(s) and to each of the soluble nickel anode(s).

17 Claims, No Drawings

METHOD FOR ELECTROLYTICALLY DEPOSITING A ZINC NICKEL ALLOY LAYER ON AT LEAST A SUBSTRATE TO BE TREATED

The present application is a U.S. National Stage Application based on and claiming benefit and priority under 35 U.S.C. § 371 of International Application No. PCT/EP2018/072425, filed 20 Aug. 2018, which in turn claims benefit of and priority to European Application No. 17193725.3 filed 28 Sep. 2017, the entirety of both of which is hereby incorporated herein by reference.

FIELD OF THE INVENTION

The present invention relates to a method for electrolytically depositing a zinc-nickel alloy layer on at least a substrate to be treated, wherein the method comprises the following method steps:

i. providing an electrolysis reaction container comprising at least a soluble zinc anode and at least a soluble nickel anode;
ii. providing an acidic electrolyte comprising at least a zinc ion source and at least a nickel ion source;
iii. filling of the electrolysis reaction container of method step (i) with the acidic electrolyte of method step (ii);
iv. providing at least a substrate to be treated in said electrolysis reaction container, which has been filled with the acidic electrolyte;
v. executing an electrolytical deposition of a zinc-nickel alloy layer on a surface of said substrate to be treated by applying a current from at least an external current source to each of the soluble zinc anode(s) and to each of the soluble nickel anode(s);
vi. terminating applying the current from said external current source to each of the soluble zinc anode(s) and to each of the soluble nickel anode(s);
vii. remaining of at least one soluble zinc anode and at least one soluble nickel anode in the electrolysis reaction container, which remains filled with an acidic electrolyte comprising at least a zinc ion source and at least a nickel ion source, without executing electrolytical deposition of a zinc-nickel alloy layer on the surface of said substrate to be treated for a defined period of time in which no current from said external current source is applied to each of the soluble zinc anode(s) and to each of the soluble nickel anode(s); and
viii. restarting of executing of the electrolytical deposition of a zinc-nickel alloy layer on the surface of said substrate to be treated by restarting applying the current from said external current source to each of the soluble zinc anode(s) and to each of the soluble nickel anode (s).

BACKGROUND OF THE INVENTION

The electrolytical deposition of zinc-nickel alloy layers on a surface of a substrate to be treated have been applied widespread in numerous technical fields. It has been used especially in the field of corrosion protection due to known good corrosion protection properties of zinc containing layers, in particular if zinc is combined with nickel in zinc-nickel alloy layers. Examples for such a technical application in the field of corrosion protection are anti-corrosive layers on small construction elements like screws by executing barrel plating processes. Therefore, the automotive industry has an enormous demand for suitable processes for zinc-nickel alloy plating.

There are numerous documents known in which such conventional electrolytical zinc-nickel plating processes have been described already, such as in the DE 101 46 559 A1 or in the DE 195 38 419 A1.

A known problem of these electrolytical zinc-nickel alloy plating processes, which make commonly use of acidic electrolytes, is the usage of soluble zinc anodes. It is known that a black passivating deposit is formed on the surface of the soluble zinc anodes during the processes, and especially during time periods in which the electrolytical deposition process of the respective zinc-nickel alloy plating is interrupted, such as for common work breaks like week-ends, maintenance reasons or alike.

Said black passivating deposits on the surface of the soluble zinc anodes passivate the active surface of the soluble zinc anodes, which is disadvantageous for the plating efficiency of the electrolytical zinc-nickel deposition. Additionally, it can lead to non-uniformly eroded soluble zinc anodes from which, in a worst case, parts of the soluble zinc anodes can fall down in the reaction container. Such a contamination of the reaction container filled with the respective electrolyte is of course not desired and a known severe disadvantage in a production facility at a customer's site.

One approach has been the usage of so-called anode bags, which are arranged around the soluble zinc anodes during the process and especially in time periods in which the electrolytical deposition process of the respective zinc-nickel alloy layer is interrupted, such as for common work breaks like week-ends, maintenance reasons or alike. These anode bags are permeable for ions in both directions so that the electrolytical process is not hampered by them. However, this approach solely avoids that such parts of the soluble zinc anodes can still fall into the reaction container, but it does not avoid the formation of the black passivating deposit on the surface of the soluble zinc anodes. Furthermore, these so-called anode bags have to be cleaned regularly, which is again causing effort and cost.

Currently, the soluble zinc anodes have to be stored in separate containers outside of the reaction container in said time periods in which the electrolytical deposition process of the respective zinc-nickel alloy layer is interrupted. This can cause production line contamination caused by parts of the soluble zinc anodes and their black passivating deposit, which fall down during the removal of said anodes out of the reaction container. This again generates high maintenance effort and thereby high cost.

The most common approach in the moment is to remove said black passivating deposit from the surface of the soluble zinc anodes by making use of an inorganic acid, such as hydrochloric acid, before an electrolytical zinc-nickel alloy process is initiated or re-initiated. Especially after having a work break in production cycles, this is a severe requirement in the moment to remove this black passivating deposit and thereby to reactivate the surface of the soluble zinc anodes by such an acid.

However, to apply this acid, all soluble zinc anodes have to be taken out of the respective reaction container, which causes again a huge effort regarding manpower, time, and especially required storage space outside of the reaction container for all these zinc anodes.

In DE 20 2008 014 947 U1 these known problems in zinc-containing acidic plating processes are attempted to overcome by making use of an ion-exchange membrane, especially a cationic ion exchange membrane.

Such an adaption of existing process lines for electrolytical zinc-nickel deposition by an additional inclusion of an electrolyte circuit flowing through such a membrane is highly costly for customers due to its known character as expensive auxiliary equipment, which requires numerous additional technical parts like membrane compartments, pipes, tubes, valves, tanks and pumps.

Other approaches to avoid the formation of this black passivating deposit on the surface of the soluble zinc anodes has been attempts to execute the electrolytical acidic zinc-nickel deposition process with higher anodic current densities or with higher concentrations of complexing agents in the respective acidic electrolyte.

However, these attempts have not been successfully in order to completely avoid the formation of the black passivating deposit. The formation of the black passivating deposit could only be reduced to some limited extent. If the anodic current density is increased too far herein by reducing the anode surface area too much, the voltage required for initiating the process is highly increasing. The higher said voltage is increasing, the more gas will be produced on the surface of the zinc anodes because more and more energy will be used for generating gas instead of being used for the respective electrolytical process. This makes the process more and more inefficient on the one side, but also increases the cost more and more on the other side because it requires more expensive equipment parts, such as more powerful rectifiers.

OBJECTIVE OF THE PRESENT INVENTION

In view of the prior art, it was thus an object of the present invention to provide a method for acidic electrolytical zinc-nickel deposition on a substrate to be treated, which shall not exhibit the aforementioned shortcomings of the known prior art methods.

In particular, it was an object of the present invention to provide a method which shall be able to avoid the formation of the known black passivating deposit on the surface of the soluble zinc anodes in time periods in which the electrolytical deposition process of the respective zinc-nickel alloy layer is interrupted.

Furthermore, it was an object to provide a method, which allows that the soluble zinc anodes remain in the electrolyte in time periods in which the electrolytical deposition process of the respective zinc-nickel alloy layer is interrupted, and which are not requiring an activation of said soluble zinc anodes after initiating or re-initiating the electrolytical zinc-nickel deposition.

SUMMARY OF THE INVENTION

These objects and also further objects which are not stated explicitly but are immediately derivable or discernible from the connections discussed herein by way of introduction are achieved by a method having features disclosed herein. Appropriate modifications to the inventive method are further disclosed herein.

The present invention accordingly provides a method for electrolytically depositing a zinc-nickel alloy layer on at least a substrate to be treated, wherein the method comprises the following method steps:

i. providing an electrolysis reaction container comprising at least a soluble zinc anode and at least a soluble nickel anode;

ii. providing an acidic electrolyte comprising at least a zinc ion source and at least a nickel ion source;

iii. filling of the electrolysis reaction container of method step (i) with the acidic electrolyte of method step (ii);

iv. providing at least a substrate to be treated in said electrolysis reaction container, which has been filled with the acidic electrolyte;

v. executing an electrolytical deposition of a zinc-nickel alloy layer on a surface of said substrate to be treated by applying a current from at least an external current source to each of the soluble zinc anode(s) and to each of the soluble nickel anode(s);

vi. terminating applying the current from said external current source to each of the soluble zinc anode(s) and to each of the soluble nickel anode(s);

vii. remaining of at least one soluble zinc anode and at least one soluble nickel anode in the electrolysis reaction container, which remains filled with an acidic electrolyte comprising at least a zinc ion source and at least a nickel ion source, without executing electrolytical deposition of a zinc-nickel alloy layer on the surface of said substrate to be treated for a defined period of time in which no current from said external current source is applied to each of the soluble zinc anode(s) and to each of the soluble nickel anode(s); and viii. restarting of executing of the electrolytical deposition of a zinc-nickel alloy layer on the surface of said substrate to be treated by restarting applying the current from said external current source to each of the soluble zinc anode(s) and to each of the soluble nickel anode (s); wherein in method step (vii) said at least one soluble zinc anode, which is remaining in the electrolysis reaction container, is electrically connected by an electrical connection element to form an electrical connection to said at least one soluble nickel anode, which is remaining in the electrolysis reaction container, for at least a part of the defined period of time.

It is thus possible in an unforeseeable manner to provide a method for acidic electrolytical zinc-nickel deposition on a substrate to be treated, which does not exhibit the aforementioned shortcomings of the known prior art methods.

Additionally, the process of the present invention offers an amended method which avoids the formation of the known black passivating deposit on the surface of the soluble zinc anodes in time periods in which the electrolytical deposition process of the respective zinc-nickel alloy layer is interrupted.

In addition thereto, the method of the present invention allows that the soluble zinc anodes can remain in the electrolyte in time periods in which the electrolytical deposition process of the respective zinc-nickel alloy layer is interrupted.

Furthermore, the method does not require an activation of the soluble zinc anodes after initiating or re-initiating the electrolytical zinc-nickel deposition.

The inventive method is easily executable in all already existing acidic zinc-nickel electrolytical deposition lines without that any kind of additional expensive auxiliary equipment, such as rectifiers or membrane anodes, have to be used.

The absence of the formation of the black passivating deposit enables also a very uniform consumption of the soluble zinc anodes, which saves cost due to a highly reduced maintenance effort and to a general reduced consumption of zinc anodes.

DETAILED DESCRIPTION OF THE INVENTION

As used herein, the term "zinc ion source" in accordance with the present invention refers to any kind of chemical compound, which is suitable to provide zinc ions in the electrolyte. For this purpose, a zinc salt or a zinc complex is exemplarily suitable.

As used herein, the term "nickel ion source" in accordance with the present invention refers to any kind of chemical compound, which is suitable to provide nickel ions in the electrolyte. For this purpose, a nickel salt or a nickel complex is exemplarily suitable.

As used herein, the term "terminating applying the current from said external current source" in method step (vi) in accordance with the present invention refers to an action, wherein the application of current from an external current source is switched off.

The term "defined period of time in which no current from said external current source is applied to each of the soluble zinc anode(s) and to each of the soluble nickel anode(s)" refers to a period of time in method step (vii), which is beginning subsequently to the action of terminating applying the current in method step (vi).

The term "filled with an acidic electrolyte" in method step (vii) refers to an acidic electrolyte comprising at least a zinc ion source and at least a nickel ion source. Preferably it is the electrolyte of method step (ii).

As used herein, the term "remaining of at least one soluble zinc anode and at least one soluble nickel anode in the electrolysis reaction container, which remains filled with an acidic electrolyte comprising at least a zinc ion source and at least a nickel ion source" in accordance with the present invention refers to a situation, wherein a customer possibly removes one or more than one soluble zinc and/or nickel anodes out of the electrolysis reaction container during the defined period of time in method step (vii). However, it is necessary that at least one soluble zinc anode and at least one soluble nickel anode still remain in the electrolyte in the electrolysis reaction container. Furthermore, the electrolyte has at least to remain up to a certain liquid level in the electrolysis reaction container in such a way that the soluble zinc and nickel anodes being in said container are still reaching at least partially, preferably completely, into the electrolyte.

The electrical connection of the at least one soluble zinc anode to the at least one soluble nickel anode in method step (vii) can be exemplarily formed by an electrical cable. Conclusively, the electrical cable allows the flow of current between such a zinc anode and a nickel anode without making use of an external current source. In principle, it works like a short-circuited galvanic cell. The current, which flows now between zinc anode and nickel anode, is caused by the difference of the electrochemical potential of zinc and nickel. Thus, elemental nickel is deposited on the surface of the respective zinc anode. The amount of nickel ions, which is able to be deposited on the zinc electrode surface, is decreasing by time. This is caused by the increased covering of the former zinc surface of the zinc electrode by the deposited nickel. That means that the total thickness of the nickel deposit is limited to a certain extent, which avoids that the nickel deposit is becoming too thick.

As used herein, the term "electrical connection element" in accordance with the present invention refers not to an electrolyte.

If the method is restarting the executing of an electrolytical deposition of a zinc-nickel alloy layer on the surface of said substrate to be treated by restarting applying the current from said external current source to each of the soluble zinc anode(s) and to each of the soluble nickel anode(s), the electrical connection between the soluble zinc anode(s) and the respective soluble nickel anode(s) has to be removed again at the latest to the time of entering method step (viii). As soon as the current from the external current source is applied again in method step (viii) to the soluble zinc and nickel anodes, the nickel deposit is going immediately again in solution (in the electrolyte). There is no obstacle due to the present nickel deposit on the surface of the zinc anode for restarting the method of electrolytical deposition of a zinc-nickel alloy layer on the surface of a substrate to be treated in the acidic electrolyte.

Nickel and zinc anodes can be chosen as commonly required by these known electrolytical acidic zinc-nickel deposition methods. Zinc anodes can exemplarily be a plate, a sheet, a bar, or a bar with continuous titanium core inside of the zinc anode bar.

In one embodiment, in method step (vii) said at least one soluble zinc anode, which is remaining in the electrolysis reaction container, is electrically connected by an electrical connection element to form an electrical connection to said at least one soluble nickel anode, which is remaining in the electrolysis reaction container, for the entire defined period of time.

This is advantageous because it minimizes the time in which further black passivating deposit can be deposited on the surface of the soluble zinc anodes.

In one embodiment, in method step (vii) each soluble zinc anode, which is remaining in the electrolysis reaction container, is electrically connected by an electrical connection element to form an electrical connection to at least one soluble nickel anode, which is remaining in the electrolysis reaction container.

It is of course preferred to protect all soluble zinc anodes by the nickel deposit executed in inventive method step (vii). This minimizes effort for maintenance reasons.

In one embodiment, in method step (vii) the defined period of time is at least 10 minutes, preferably at least 1 hour, and more preferably at least 3 hours.

The longer the defined period of time is, the more black passivating deposit is deposited on the surface of the soluble zinc anodes.

In one embodiment, in method step (viii) the restarting of execution of the electrolytical deposition of a zinc-nickel alloy layer on the surface of said substrate to be treated is done without an activation of at least a soluble zinc anode, preferably without an activation by an acid, more preferably without an activation by an inorganic acid, and most preferably without an activation by hydrochloric acid, sulfuric acid or mixtures thereof.

This saves maintenance effort and cost.

In one embodiment, the method does not comprise the provision and/or utilization of any kind of membrane in the electrolysis reaction container.

The application of such expensive technical equipment can be avoided by the inventive method claimed herein. There is no need to provide membrane anode systems comprising separated compartments inside of the electrolysis reaction container divided by membranes.

In one embodiment, the method does not comprise the provision and/or utilization of any kind of anode bags.

In one embodiment, in method step (vii) all soluble zinc anodes remain in the electrolysis reaction container filled with the acidic electrolyte for at least a part of the defined period of time, preferably for the entire defined period of time.

This is a clear advantage of the inventive method. A customer solely still need to take the zinc anodes out of the electrolysis reaction container for general replacement due to the consumption of the anode material by the method, but no more caused by the black passivating deposit. The formation of this black passivating deposit is in literature also called sometimes "cementation effect".

In one embodiment, in method step (vii) the electrical connection between said at least one soluble zinc anode, which is remaining in the electrolysis reaction container, and said at least one soluble nickel anode, which is remaining in the electrolysis reaction container, is terminated automatically, preferably by a mechanical switch, at the latest at the beginning of method step (viii), if said electrical connection is still present at that time.

This offers the advantage that no trained user has to be present at customer's site for disconnecting the zinc anodes from the nickel anodes before the external current source is switched on again simultaneously or subsequently. The possibility of automatic interruption of the electrical connection between the at least one soluble zinc anode and the at least one soluble nickel anode reduces further the effort at customer's site in order to adapt especially already existing plating lines with this new inventive method. The customer has solely to install in a preferred embodiment thereof an automatic mechanical switch for the electrical connection between the at least one soluble zinc anode and the at least one soluble nickel anode.

In one embodiment, in method step (v) the soluble zinc anode(s) has/have an anodic current density ranging from 1 to 6 ASD, preferably from 2 to 6 ASD, and more preferably from 3 to 5 ASD.

ASD is commonly used in the galvanic industry and means also here in the context of the present invention ampere per square decimeter. If the anodic current density is higher than 6 ASD, it leads to numerous disadvantageous effects, such as excessive dissolving of the zinc anodes, high heat development, bad geometric metal distribution on the surface of the substrate to be treated and bad metal throwing power.

In one embodiment, the acidic electrolyte has a pH-value ranging from 4 to 6, preferably from 4.5 to 5.8, and more preferably from 5.2 to 5.6.

If the pH is becoming too high, nickel hydroxides are formed, which are known as disadvantageous in this acidic electrolytical deposition methods.

In one embodiment, in method step (v) the temperature of the acidic electrolyte is ranging from 20 to 55° C., preferably from 25 to 50° C., and more preferably from 30 to 45° C.

In one embodiment, the zinc ion concentration in the acidic electrolyte is ranging from 10 to 100 g/l, preferably from 12 to 70 g/l, and more preferably from 17 to 38 g/l.

In one embodiment, the nickel ion concentration in the acidic electrolyte is ranging from 10 to 100 g/l, preferably from 15 to 60 g/l, and more preferably from 23 to 32 g/l.

In one embodiment, the electrical connection element is an electrical cable.

The present invention thus addresses the problem of avoiding the formation of the black passivating deposits on the surface of soluble zinc anodes in a defined period of time in which no current from the at least one external current source is applied to each of the soluble zinc anode(s) and to each of the soluble nickel anode(s) during such an acidic electrolytical zinc-nickel deposition method.

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the appended claims.

The invention claimed is:

1. Method for electrolytically depositing a zinc-nickel alloy layer on at least a substrate to be treated, wherein the method comprises the following method steps:

i. providing an electrolysis reaction container comprising at least one soluble zinc anode and at least one soluble nickel anode;

ii. providing an acidic electrolyte comprising at least a zinc ion source and at least a nickel ion source;

iii. filling of the electrolysis reaction container of method step (i) with the acidic electrolyte of method step (ii);

iv. providing at least a substrate to be treated in said electrolysis reaction container, which has been filled with the acidic electrolyte;

v. executing an electrolytical deposition of a zinc-nickel alloy layer on a surface of said substrate to be treated by applying a current from at least an external current source to each of the at least one soluble zinc anode and to each of the at least one soluble nickel anode;

vi. terminating applying the current from said external current source to each of the at least one soluble zinc anode and to each of the at least one soluble nickel anode;

vii. remaining of the at least one soluble zinc anode and the at least one soluble nickel anode in the electrolysis reaction container, which remains filled with the acidic electrolyte comprising at least a zinc ion source and at least a nickel ion source, without executing the electrolytical deposition of the zinc-nickel alloy layer on the surface of said substrate to be treated for a defined period of time in which no current from said external current source is applied to each of the at least one soluble zinc anode and to each of the at least one soluble nickel anode; and viii. restarting of executing of the electrolytical deposition of a further zinc-nickel alloy layer on the surface of said substrate to be treated by restarting applying the current from said external current source to each of the at least one soluble zinc anode and to each of the at least one soluble nickel anode;

characterized in that method step (vii) further comprises applying an electrical connection element to form an electrical connection from said at least one soluble zinc anode, which is remaining in the electrolysis reaction container, to said at least one soluble nickel anode, which is remaining in the electrolysis reaction container, for at least a part of the defined period of time, and wherein the electrical connection element is not the electrolyte.

2. Method for electrolytically depositing a zinc-nickel alloy layer on a substrate to be treated according to claim 1 characterized in that in method step (vii) said at least one soluble zinc anode, which is remaining in the electrolysis reaction container, is electrically connected by the electrical connection element to form the electrical connection to said at least one soluble nickel anode, which is remaining in the electrolysis reaction container, for the entire defined period of time.

3. Method for electrolytically depositing a zinc-nickel alloy layer on a substrate to be treated according to claim 1 characterized in that in method step (vii) each at least one soluble zinc anode, which is remaining in the electrolysis reaction container, is electrically connected by the electrical connection element to form the electrical connection to at least one of the at least one soluble nickel anode, which is remaining in the electrolysis reaction container.

4. Method for electrolytically depositing a zinc-nickel alloy layer on a substrate to be treated according to claim 1 characterized in that in method step (vii) the defined period of time is at least 10 minutes.

5. Method for electrolytically depositing a zinc-nickel alloy layer on a substrate to be treated according to claim 1 characterized in that in method step (viii) the restarting of execution of the electrolytical deposition of a further zinc-nickel alloy layer on the surface of said substrate to be treated is done without an activation of said at least one soluble zinc anode.

6. Method for electrolytically depositing a zinc-nickel alloy layer on a substrate to be treated according to claim 1 characterized in that the method does not comprise the provision and/or utilization of any membrane in the electrolysis reaction container.

7. Method for electrolytically depositing a zinc-nickel alloy layer on a substrate to be treated according to claim 1 characterized in that the method does not comprise the provision and/or utilization of any anode bag.

8. Method for electrolytically depositing a zinc-nickel alloy layer on a substrate to be treated according to claim 1 characterized in that in method step (vii) each of the at least one soluble zinc anode remains in the electrolysis reaction container filled with the acidic electrolyte for at least a part of the defined period of time.

9. Method for electrolytically depositing a zinc-nickel alloy layer on a substrate to be treated according to claim 1 characterized in that in method step (vii) the electrical connection between said at least one soluble zinc anode, which is remaining in the electrolysis reaction container, and said at least one soluble nickel anode, which is remaining in the electrolysis reaction container, is terminated automatically, at the latest at the beginning of method step (viii), if said electrical connection is still present at that time.

10. Method for electrolytically depositing a zinc-nickel alloy layer on a substrate to be treated according to claim 1 characterized in that in method step (v) the at least one soluble zinc anode has a current density ranging from 1 to 6 ASD.

11. Method for electrolytically depositing a zinc-nickel alloy layer on a substrate to be treated according to claim 1 characterized in that the acidic electrolyte has a pH-value ranging from 4 to 6.

12. Method for electrolytically depositing a zinc-nickel alloy layer on a substrate to be treated according to claim 1 characterized in that in method step (v) the temperature of the acidic electrolyte is ranging from 20 to 55° C.

13. Method for electrolytically depositing a zinc-nickel alloy layer on a substrate to be treated according to claim 1 characterized in that zinc ion concentration in the acidic electrolyte is ranging from 10 to 100 g/l.

14. Method for electrolytically depositing a zinc-nickel alloy layer on a substrate to be treated according to claim 1 characterized in that nickel ion concentration in the acidic electrolyte is ranging from 10 to 100 g/l.

15. Method for electrolytically depositing a zinc-nickel alloy layer on a substrate to be treated according to claim 1 characterized in that the electrical connection element is an electrical cable.

16. Method for electrolytically depositing a zinc-nickel alloy layer on a substrate to be treated according to claim 1 characterized in that in method step (viii) the restarting of execution of the electrolytical deposition of a further zinc-nickel alloy layer on the surface of said substrate to be treated is done without an activation by hydrochloric acid, sulfuric acid or mixtures thereof.

17. Method for electrolytically depositing a zinc-nickel alloy layer on a substrate to be treated according to claim 1 characterized in that the acidic electrolyte has a pH-value ranging from 5.2 to 5.6.

* * * * *